US008875991B2

(12) United States Patent
Ross et al.

(10) Patent No.: US 8,875,991 B2
(45) Date of Patent: Nov. 4, 2014

(54) PATHWAY SELECTION

(75) Inventors: Robert Ross, Waterloo (CA); Frederik Kallin, Waterloo (CA)

(73) Assignee: NCR Corporation, Duluth, GA (US)

( * ) Notice: Subject to any disclaimer, the term of this patent is extended or adjusted under 35 U.S.C. 154(b) by 170 days.

(21) Appl. No.: 13/483,316

(22) Filed: May 30, 2012

(65) Prior Publication Data

US 2013/0319816 A1 Dec. 5, 2013

(51) Int. Cl.
*G07F 19/00* (2006.01)

(52) U.S. Cl.
USPC ..... 235/379; 198/367

(58) Field of Classification Search
USPC ..... 235/379
See application file for complete search history.

(56) References Cited

U.S. PATENT DOCUMENTS

| | | | | |
|---|---|---|---|---|
| 4,871,163 | A | 10/1989 | Landa | |
| 5,868,387 | A | 2/1999 | Kida | |
| 2010/0179682 | A1* | 7/2010 | Hamasaki | 700/214 |
| 2011/0260390 | A1* | 10/2011 | Cha et al. | 271/3.17 |
| 2013/0153653 | A1* | 6/2013 | Wilson | 235/379 |

FOREIGN PATENT DOCUMENTS

| | | |
|---|---|---|
| EP | 1 445 223 | 8/2004 |
| EP | 2 143 678 | 1/2010 |

* cited by examiner

*Primary Examiner* — Allyson Trail
(74) *Attorney, Agent, or Firm* — Paul W. Martin

(57) ABSTRACT

An apparatus and method are disclosed for determining a direction of transport of an item of media. The apparatus includes a diverter housing providing at least four openings through which an item of media is transportable, a pathway guide member in a central chamber region of the housing selectively locatable in at least three orientations, said guide member comprising a plurality of guide surfaces that each guide an item of media travelling on a respective transport pathway, and at least one selection element that selects an orientation of the guide member as each item of media is transported to determine an opening through which an item of media exiting the housing is transported.

18 Claims, 8 Drawing Sheets

PATHWAY SELECTION

FIELD OF THE INVENTION

The present invention relates to a method and apparatus for determining a direction of transport of an item of media. In particular, but not exclusively, the present invention relates to apparatus which can divert and/or receive items of media such as currency notes or check in four directions in a single compact diverter mechanism.

Various situations are known in which items of media are transported along different transport pathways in a Self-Service Terminal (SST). For example, as disclosed in US2009/0159660, in a typical check depositing Automated Teller Machine (ATM), an ATM customer is allowed to deposit a check (without having to place the check in a deposit envelope) in a publicly accessible, unattended environment. To deposit a check, the ATM customer inserts a user identification card through a user card slot at the ATM, enters the amount of the check being deposited, and inserts the check to be deposited through a check slot of a check acceptor. A check transport mechanism receives the inserted check and transports the check in a forward direction along a check transport path to a number of locations within the ATM to process the check.

If the check is not accepted for deposit, the check transport mechanism transports the check in a reverse direction along the check transport path to return the check to the ATM customer via the check slot. If the check is accepted for deposit, the amount of the check is deposited into the ATM customer's account and the check is transported to a storage bin within the ATM. An endorser printer prints an endorsement onto the check as the check is being transported to and stored in the storage bin. Checks in the storage bin within the ATM are periodically picked up and physically transported via courier to a back office facility of a financial institution for further processing.

In some known check depositing ATMs, certain components are housed in modular units which, in turn, are housed in a larger module. The larger module is sometimes referred to as a "check processing module" (CPM). Such modules are included in ATMs provided by NCR Corporation, located in Dayton, Ohio. One example is Model No. CPM2 in which a modular unit called a "pocket module" is located in approximately the central portion of the CPM. Another example is Model No. CPM3 in which the pocket module is located in approximately the bottom portion of the CPM. Still another example is Model No. CPM4 in which the pocket module is located in approximately the top portion of the CPM. It would be desirable to provide a single CPM which contains components which can be configured to provide functionality of the CPM2, the CPM3 and the CPM4.

The solution disclosed in US2009/0159660 discloses a diverter mechanism which offers only a limited number of diverting possibilities. As SST product requirements call for new functionality and higher capacity which must be able to process larger bunch sizes and bin capacities, the call for more compact diverting mechanisms increases. Likewise, there is a need to provide diverting mechanisms which offer the ability to direct transported items of media in a broader range of possible directions.

SUMMARY OF THE INVENTION

It is an aim of the present invention to at least partly mitigate the above-mentioned problems.

It is an aim of certain embodiments of the present invention to provide a diverting mechanism which is capable of passing currency notes and/or checks and/or sheet-like items of media in a bi-directional path whilst being able to divert items from this flow, either in an upward or downward direction.

It is an aim of certain embodiments of the present invention to conserve module space within an SST which thereby frees up space which can be used for other functionality.

It is an aim of certain embodiments of the present invention to provide a method of determining a direction of transport for an item of media in which a compact and efficiently controlled mechanism which is not prone to error can be utilized to provide a broad range of transport pathways.

According to a first aspect of the present invention there is provided apparatus for determining a direction of transport of an item of media, comprising:

- a diverter housing providing at least four openings through which an item of media is transportable;
- a pathway guide member in a central chamber region of the housing selectively locatable in at least three orientations, said guide member comprising a plurality of guide surfaces that each guide an item of media travelling on a respective transport pathway; and
- at least one selection element that selects an orientation of the guide member as each item of media is transported to determine an opening through which an item of media exiting the housing is transported.

Aptly, the guide member comprises a first pair of opposed straight abutment surfaces that are spaced apart and substantially parallel and which extend centrally through a longitudinal length of the guide member, said straight abutment surfaces guiding an item from an input opening to an output opening substantially without deviation.

Aptly, the guide member comprises at least a first and second pair of outwardly facing arcuate abutment surfaces, each arcuate abutment surface guiding an item travelling on a respective transport pathway from an input opening to an output opening through which the item of media exits the housing with a deviation of substantially about around 90 degrees.

Aptly, the guide member can be (i) moved and releasably secured into a first guide member position when in a first mode of operation (ii) moved and releasably secured into a second guide member position when in a second mode of operation and (iii) moved and releasably secured into a third guide member position when in a third mode of operation; and

- each selection element can be (i) disposed in a first selection position to select the first mode of operation, (ii) disposed in a second selection position to select the second mode of operation and (iii) disposed in a third selection position to select the third mode of operation.

Aptly, the guide member comprises a split rocker body closed at a first and further end thereof, a driveshaft extending from at least a first end thereof with a lower surface of an upper portion of the split body providing a substantially straight abutment surface and an upper surface of a lower portion of the split body providing a further substantially straight abutment surface.

Aptly, the housing comprises four elongate body portions each having a substantially W-shaped cross-section secured together at first and second ends thereof via respective housing end walls; wherein

- each W-shaped body portion is disposed around, and with a central concave region facing, a centre of the housing, the combined space of the concave regions providing the chamber region.

Aptly, the at least one selection element comprises a sector gear connected to a driveshaft connected to the guide member, the apparatus further comprising a stepper motor that selectively engages the sector gear to locate the driveshaft in a respective first, second or third selection position.

Aptly, the apparatus further includes a sensor element that determines a position of the sector gear.

Aptly, the apparatus further includes at least two pairs of opposed nip rollers that drive items of media between openings in the housing; and a motor that drives the nip rollers.

According to a second aspect of the present invention there is provided a check or currency processing module for a Self-Service Terminal (SST), comprising a diverter housing providing at least four openings through which an item of media is transportable;

a pathway guide member in a central chamber region of the housing selectively locatable in at least three orientations, said guide member comprising a plurality of guide surfaces that each guide an item of media travelling on a respective transport pathway; and at least one selection element that selects an orientation of the guide member as each item of media is transported to determine an opening through which an item of media exiting the housing is transported and wherein each item of media is a check or currency note.

According to a third aspect of the present invention there is provided a method of determining a direction of transport for an item of media, comprising the steps of:

receiving an item of media at one of four openings in a diverter housing;

via at least one selection element, releasably securing a pathway guide member in a central chamber region of the housing in a selected one of three possible guide member positions; and via at least one abutment surface on the guide member, guiding the received item of media through a remaining opening in the diverter housing through which an item of media exiting the housing is transported.

Aptly, the method further comprises the step of driving the item of media through the remaining opening via one of at least two pairs of opposed nip rollers.

Aptly, the method further includes the step of locating the guide member in a selected guide member position by selectively energizing a stepper motor that engages with a sector gear connected to a driveshaft connected to the guide member.

Aptly, the method further includes the step of sensing a position of the sector gear via a sensor element.

According to a fourth aspect of the present invention there is provided a method of diverting an item of media, comprising the steps of:

transporting an item of media to one of two possible input openings in a diverter housing comprising four openings;

releasably securing a guide member in the housing in one of three possible guide member positions; and guiding the received item along a transport pathway in the housing to a remaining one of the four openings in the diverter housing through which an item of media exiting the housing is transported.

Certain embodiments of the present invention provide a compact diverting mechanism for determining a direction of transport of an item of media being transported within an SST.

Certain embodiments of the present invention enable items of media such as currency notes and/or checks to be passed in a bi-direction along one pathway whilst being able to selectively divert the flow either upward or downward depending upon whether a centerpiece acting as a diverter is selectively located in one of three positions.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
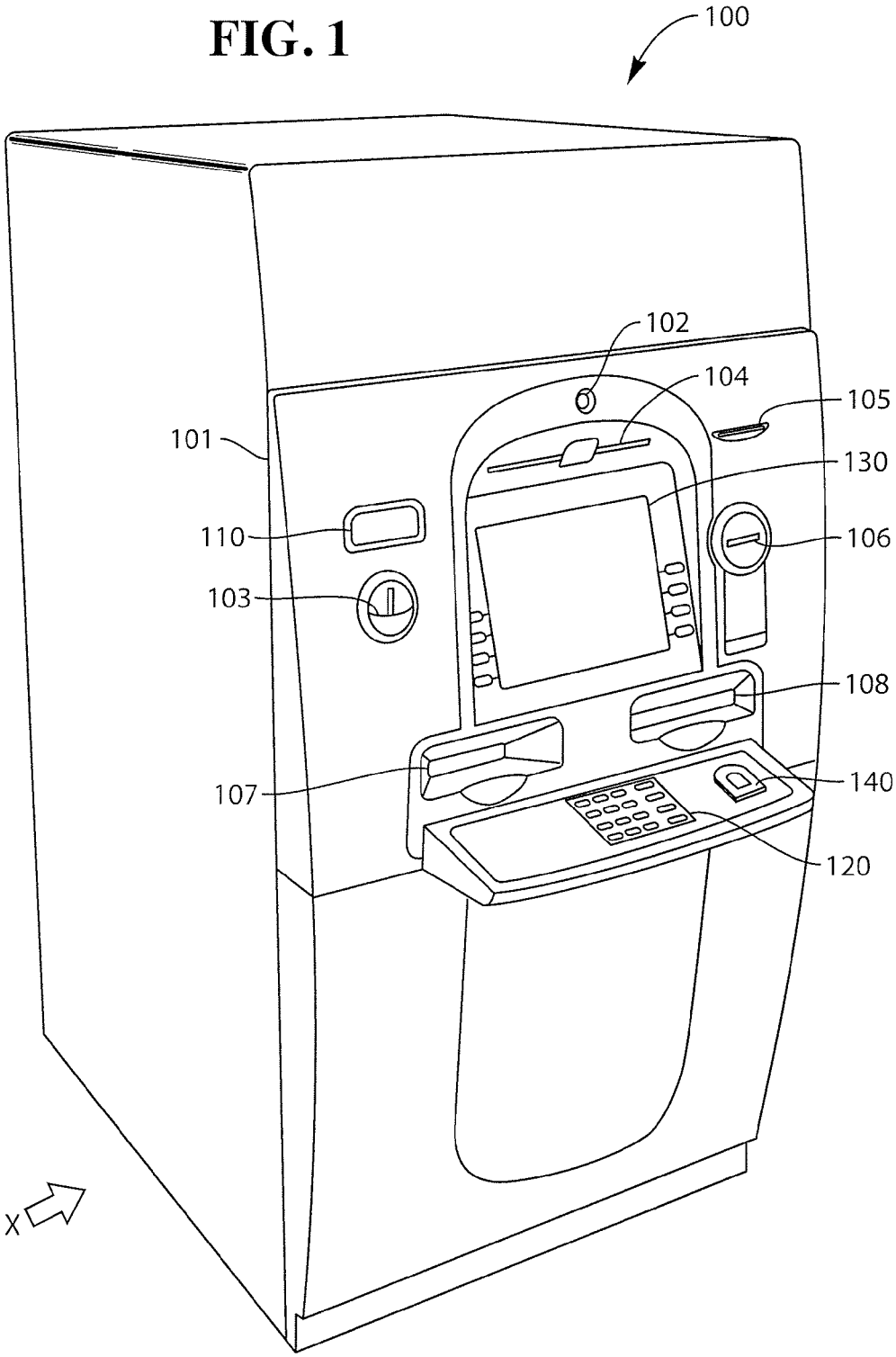
FIG. 1 illustrates an ATM according to an embodiment of the present invention.

In the drawings like reference numerals refer to like parts.

FIG. 1 illustrates a self-service check depositing terminal in the form of an image-based check depositing Automated Teller Machine (ATM) 100. It will be appreciated that certain embodiments of the present invention are applicable to a wide variety of terminals in which items of media such as checks and/or currency notes and/or giros and/or lottery tickets and/or other such flexible sheet-like items of media are to be transported and directed in different directions. The type of terminal will of course be appropriate for the type of items of media being transported.

As illustrated in FIG. 1, the ATM 100 includes a fascia 101 coupled to a chassis (not shown). The fascia 101 defines an aperture 102 through which a camera (not shown) images a customer of the ATM 100. The fascia 101 also defines a number of slots for receiving and dispensing media items and a tray 103 into which coins can be dispensed. The slots include a statement output slot 104, a receipt slot 105, a card reader slot 106, a cash slot 107, a further cash slot 108 and a check input/output slot 110. The slots and tray are arranged such that the slots and tray align with corresponding ATM modules mounted within the chassis of the ATM.

The fascia 101 provides a user interface for allowing an ATM customer to execute a transaction. The fascia 101 includes an encrypting keyboard 120 for allowing an ATM customer to enter transaction details. A display 130 is provided for presenting screens to an ATM customer. A fingerprint reader 140 is provided for reading a fingerprint of an ATM customer to identify the ATM customer.

Within the chassis of the ATM it will be understood that items of media must be transported from time to time from one location to another. The pathway taken by any particular item of media is dependent upon an operation being carried out at the ATM and may also be dependent upon other factors such as whether a user of the ATM is authorized and/or whether an item of media being transported satisfies certain pre-determined criteria.

Figure 2:
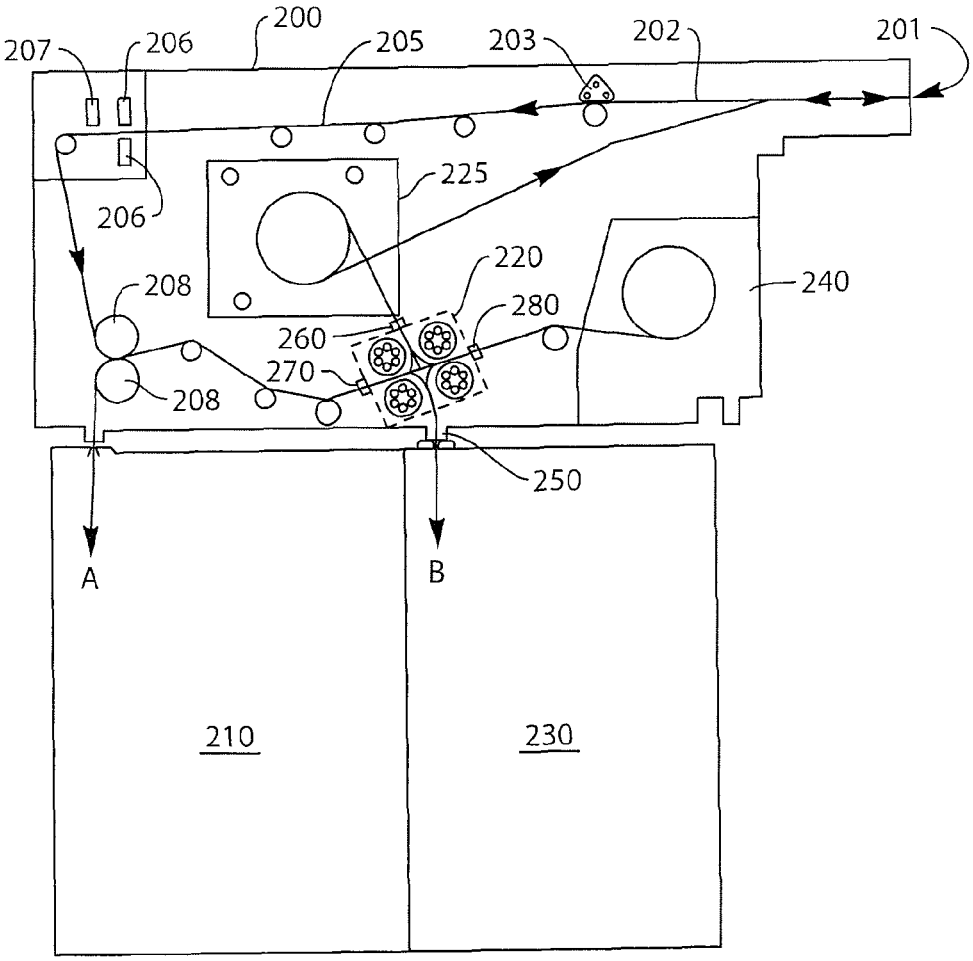
FIG. 2 illustrates transport pathways within the ATM.

FIG. 2 illustrates possible transport pathways and a diverter mechanism which can be provided within the ATM and which is a compact mechanism for diverting items of media being transported in selected directions. In more detail, FIG. 2 illustrates internal modules within the ATM which can be utilized to process deposited checks. A check processing module 200 has an access mouth 201 through which incoming checks and/or currency notes are deposited or outgoing checks are dispensed. This mouth 201 is aligned with an infeed aperture in the ATM which thus provides an input/output slot 110. A bunch of one or more items is input or output. Aptly, a bunch of up to 100 items can be received/dispensed. Aptly, a bunch of up to 500 items can be received/dispensed. Incoming checks follow a first transport path 202 away from the mouth 201 in a substantially horizontal direction from right to left shown in FIG. 2. They then pass through a feeder/separator 203 and along another pathway portion 205 which is also substantially horizontal and right to left. The items are then de-skewed and read by imaging cameras 206 and an MICR reader 207. Items are then are directed substantially vertically downwards to a point between two nip rollers 208. These nip rollers co-operate and are rotated in opposite directions with respect to each other to either draw deposited checks inwards (and urge those checks towards the right hand side in FIG. 2), or during another mode of operation, the rollers can be rotated in an opposite fashion to direct processed checks downwards in the direction shown by arrow A in FIG. 2 into a check bin 210. Incoming checks which are moved by the nip rollers 208 towards the right enter a diverter mechanism 220 which will be described hereinafter in more detail. The diverter mechanism can either divert the incoming checks and/or currency notes upwards (in FIG. 2) into a re-buncher unit 225, or downwards in the direction of arrow B in FIG. 2 into a cash bin 230, or to the right hand side shown in FIG. 2 into an escrow 240. Items of media from the escrow 240 can selectively be removed from the drum and re-processed after temporary storage. This results in items of media moving from the escrow 240 towards the left hand side of FIG. 2 where again they will enter the diverter mechanism 220. The diverter mechanism can be utilized to allow the transported checks to move substantially unimpeded towards the left hand side and thus the nip rollers 208 or upwards towards the recycler 225. Currency notes from the escrow can be directed to the re-buncher 225 or downwards into the cash bin 230.

Figure 3:
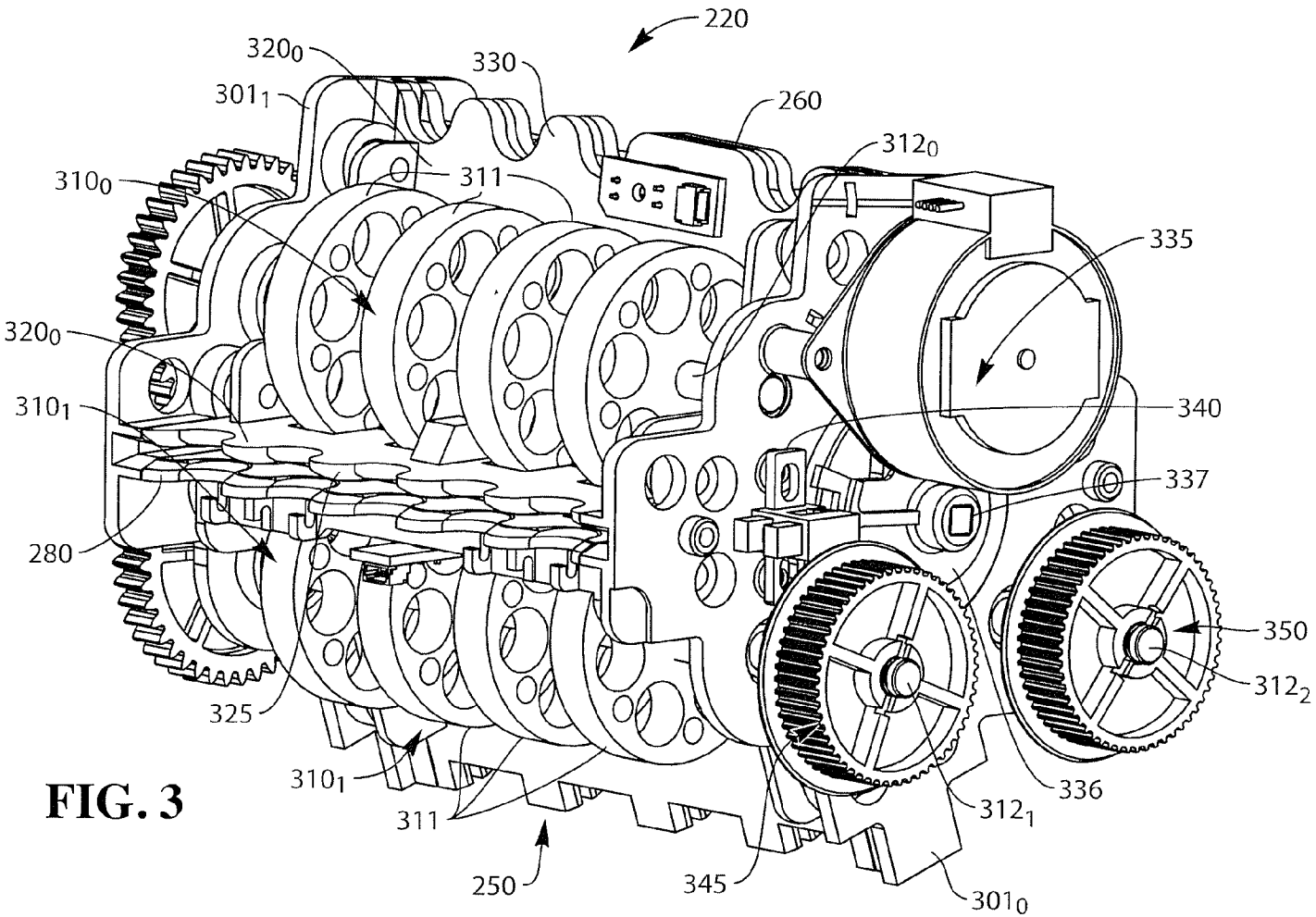
FIG. 3 illustrates a diverter mechanism.

FIG. 3 illustrates the diverter mechanism 220 in more detail. The mechanism itself includes two substantially planar plates held apart in a spaced apart relationship. The plates $\mathbf{301}_0$, $\mathbf{301}_1$ are spaced apart by rigid bars and support four shafts which are utilized to support four sets $\mathbf{310}_{0\text{-}3}$ of four drive rollers (only $\mathbf{310}_0$ and $\mathbf{310}_1$ are shown in FIG. 3). In FIG. 3 a first set $\mathbf{310}_0$ of four drive rollers 311 is provided by four aligned rollers 311 mounted on a common driveshaft $\mathbf{312}_0$. A further set $\mathbf{310}_1$ of four rollers 311 is shown mounted in an aligned adjacent fashion on a further common driveshaft $\mathbf{312}_1$. The diverter mechanism 220 includes four shafts $\mathbf{312}_{0\text{-}3}$ (although only two of these are visible in FIG. 3) and two of these are directly driven. Each driven shaft 312 can be selectively driven to rotate the rollers 311 which operate in a coupled and opposed manner to assist in moving items of media through the diverter mechanism 220. This is illustrated more clearly in FIGS. 6, 7 and 8.

FIG. 3 also helps illustrate the various input/output orifices 250, 260, 270, 280 of the diverter mechanism. These are formed by opposed spaced apart crenulated ends of four substantially W-shaped bodies which extend between the end plates 301 of the diverter mechanism. Together, the four W-shaped bodies create a housing including a central chamber region which holds a pathway guide. For example, as illustrated in FIG. 3, a first diverter mechanism body $\mathbf{320}_0$ is formed with a set of crenulations 325 which form part of the open mouth 280 leading to the escrow 240. These crenulations then extend inwards towards an inner region of the diverter mechanism and are indented to form a quarter part of the inner chamber within the diverter mechanism (shown more clearly in further drawings). The first body part then extends substantially at ninety degrees to the first set of crenulations into a further set of crenulations 330 which form part of the mouth 260 leading to the re-buncher 225. It will be understood that items of media such as checks are repeatedly moved towards and through opposed crenulations in opposed body parts of the diverter mechanism and the tapered and crenulated cross-section helps direct and guide the incoming and outgoing items of media so as to reduce the risk of blockage or error.

As illustrated in FIG. 3, the diverter mechanism also utilizes a stepper motor 335 which engages with a sector gear 336. The sector gear 336 has three possible positions and is connected to a shaft 337 which extends longitudinally through the centre of the diverter mechanism. As the stepper motor 335 is driven, the sector gear is located in one of the three possible locations which selectively rotates the shaft 337 which moves with the sector gear. The shaft is turned to one of three possible positions. The shaft is releasably held in a selected orientation as determined by the stepper motor 335 action. The shaft carries a pathway guide (shown in further drawings) which, when located in one of the three positions, determines a respective transport pathway through the mechanism. A sensor 340 is utilized to verify the position of the sector gear 336 and thus the position of the pathway guide member which is in the central chamber within the diverter mechanism. Two drive pulleys 345, 350 are driven by a respective belt and a further stepper motor shown in FIG. 5 and each drives a respective shaft $\mathbf{312}_1$, $\mathbf{312}_2$ to which the sets 310 of rollers are secured. For example, the drive pulley 345 in the left hand side position shown in FIG. 3 drives a driveshaft $\mathbf{312}_1$ which rotates the lower set $\mathbf{310}_1$ of four rollers.

Figure 4:
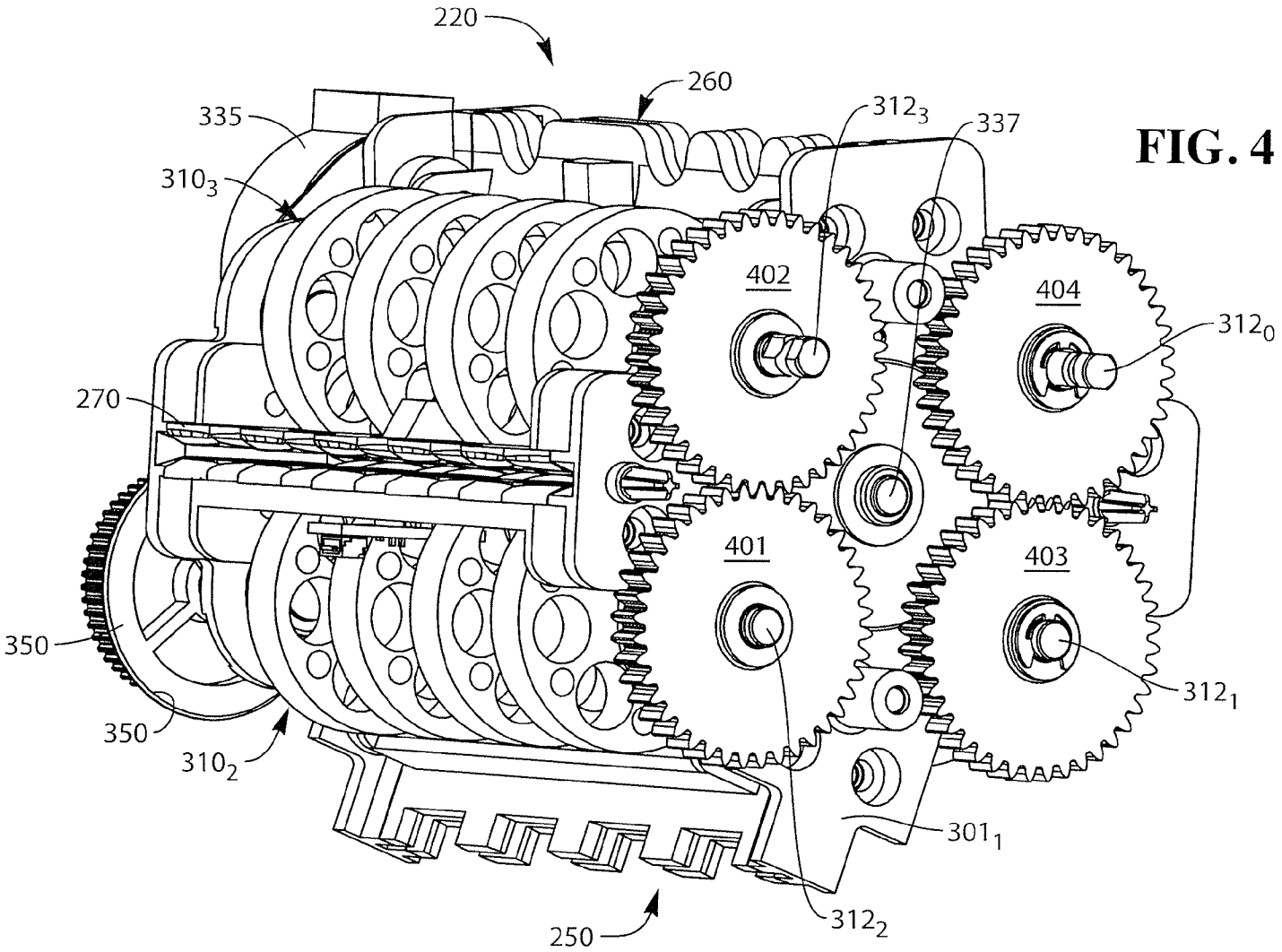
FIG. 4 illustrates a further view of the diverter mechanism.

FIG. 4 illustrates a reverse end view of the diverter mechanism shown in FIG. 3 and illustrates how the driveshafts protrude through the end of the diverter mechanism housing beyond the plate $\mathbf{301}_1$. Each shaft which carries a respective set $\mathbf{310}_{0\text{-}3}$ of drive rollers has, at the end shown in FIG. 4, a drive gear which is able to transfer drive provided by the drive pulleys on one shaft to a further shaft and thus drive the opposed set of four rollers forming a pair.

For example, as illustrated in FIG. 4, the drive pulley 350 shown in FIG. 3 at the left hand side is connected to a shaft $\mathbf{312}_2$ which drives a drive gear 401. As this rotates the gear drives an opposed gear 402 which is connected to a further driveshaft $\mathbf{312}_3$. This is used to support a set $\mathbf{310}_3$ of four opposed rollers. Likewise, rotation of the remaining drive pulley 345 shown in FIG. 3 will rotate a respective shaft $\mathbf{312}_1$ which drives the set $\mathbf{310}_1$ of four rollers mounted upon it.

As the driveshaft $\mathbf{312}_1$ connected to this remaining pulley 345 is driven by rotation of the drive pulley 345, this drives a drive gear 403 connected to the shaft. Driving this drive gear 403 rotates and thereby drives an opposed gear 404 which is connected to the driveshaft $\mathbf{312}_3$ above which thus rotates a set $\mathbf{310}_3$ of rollers. It will be appreciated that the drive rollers and shafts may be independently driven or alternatively different pairs driven by different motors/pulley systems.

FIG. 4 also helps illustrate how the central shaft 337 connected to the sector gear 336 extends longitudinally through the diverter mechanism and is supported in the end plate $\mathbf{301}_1$.

Figure 5:
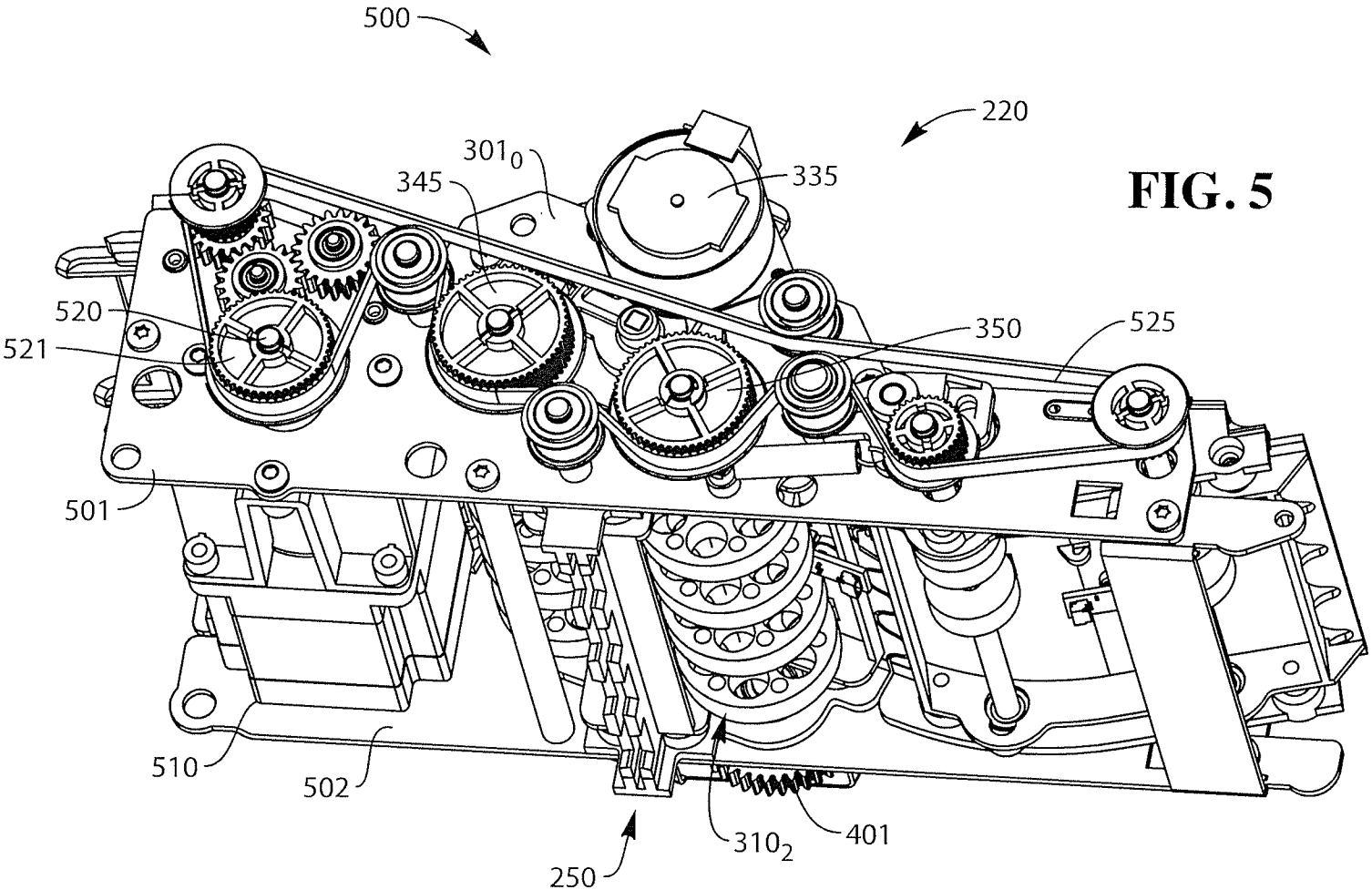
FIG. 5 illustrates the diverter mechanism housed adjacent to a stepper motor.

FIG. 5 illustrates a diverter module 500 used to support the diverter mechanism 220 in an appropriate position within the ATM. As illustrated in FIG. 5, the diverter mechanism 220 is supported between adjacent side plates 501, 502 of a housing with a further stepper motor 510 also secured therebetween.

The stepper motor drives a driveshaft 520 secured to a pulley 521 and, as this pulley 521 rotates, it drives an endless belt 525. This endless belt movement drives the pulleys 345, 350 which eventually drive the rollers of the diverter mechanism.

Figure 6:
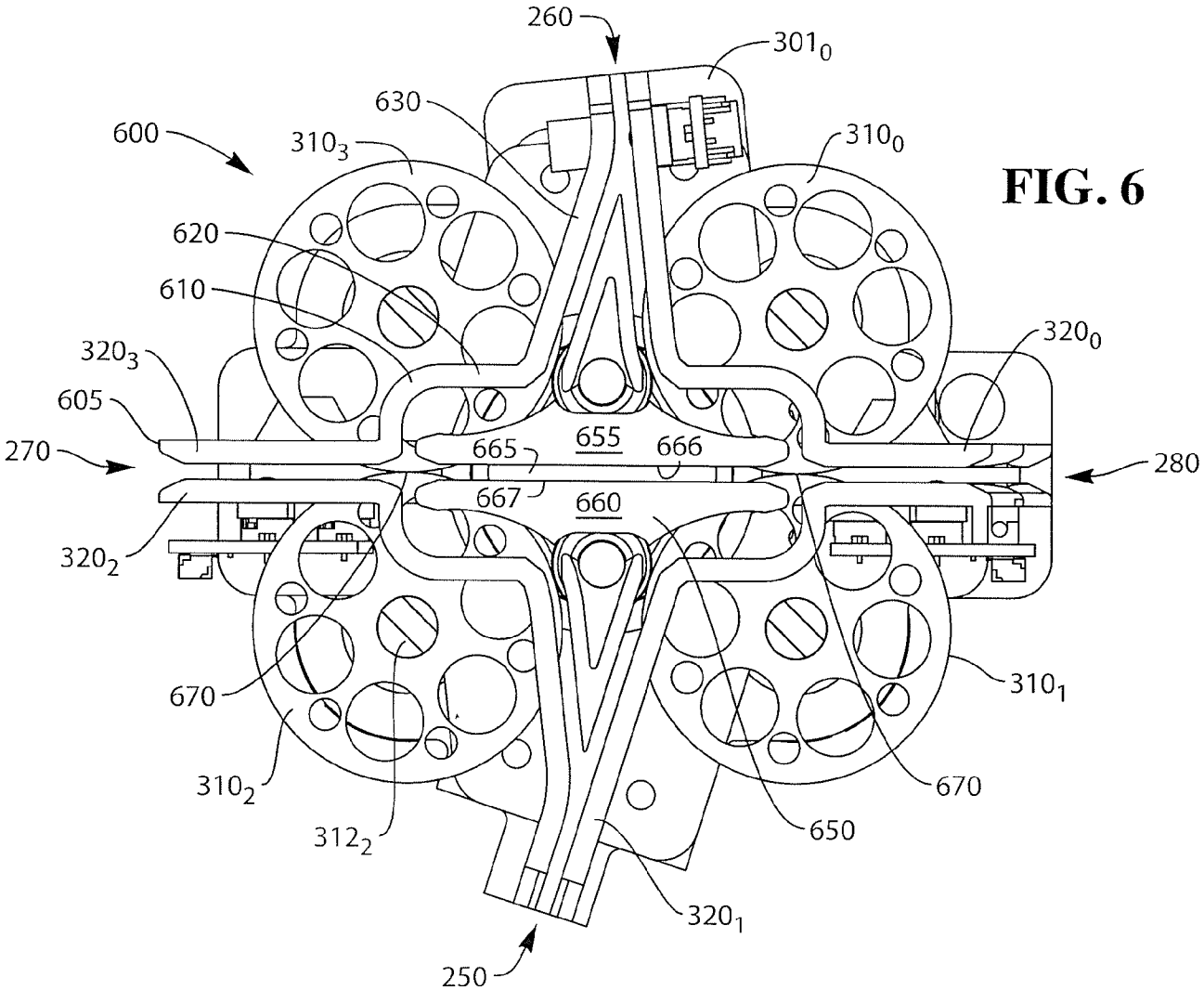
FIG. 6 illustrates a diverter mechanism in a first orientation.

FIG. 6 illustrates how a diverter housing 600 is formed by four body sections $\mathbf{320}_{0\text{-}3}$. Each respective body section 320 has a substantially W-shaped cross-section. For example, in the top left hand corner of FIG. 6, one of the W-shaped parts $\mathbf{320}_3$ has a first end 605 which forms crenulations at a respective opening 270. The body extends from this end 605 in a linear fashion inwards towards the centre of the housing body and then a concave region 610 is formed by the body turning at approximately ninety degrees into the concave region 610. A further linear region 620 is then followed until a further turn occurs in the body followed by a further linear section 630 leading towards another crenulated region and another opening 260. Because a central region of each of the W-shaped body parts is concave, a combined space is produced in the centre of the housing in which a pathway guide 650 is located. The pathway guide 650 is rotated as the sector gear 336 is put in one of the three possible positions by the stepper motor 335 activation. FIG. 6 illustrates the pathway guide 650 in a first orientation in which an upper body part 655 and lower body part 660 are arranged so that a spaced apart guide slot region 665 between opposed inner surfaces 666, 667 of the pathway guide are aligned to allow a through path between the left hand side opening 270 and right hand side opening 280 shown in FIG. 6. It will be appreciated that in this configuration, items entering from the left or right can pass directly through the diverter mechanism substantially without deviation.

FIG. 6 also helps illustrate how the sets $\mathbf{310}_{0\text{-}3}$ of rollers are juxtaposed in pairs providing respective nip points 670. By rotation of the rollers in an appropriate direction, it will be appreciated that items of media can be driven through the diverter mechanism.

Figure 7:
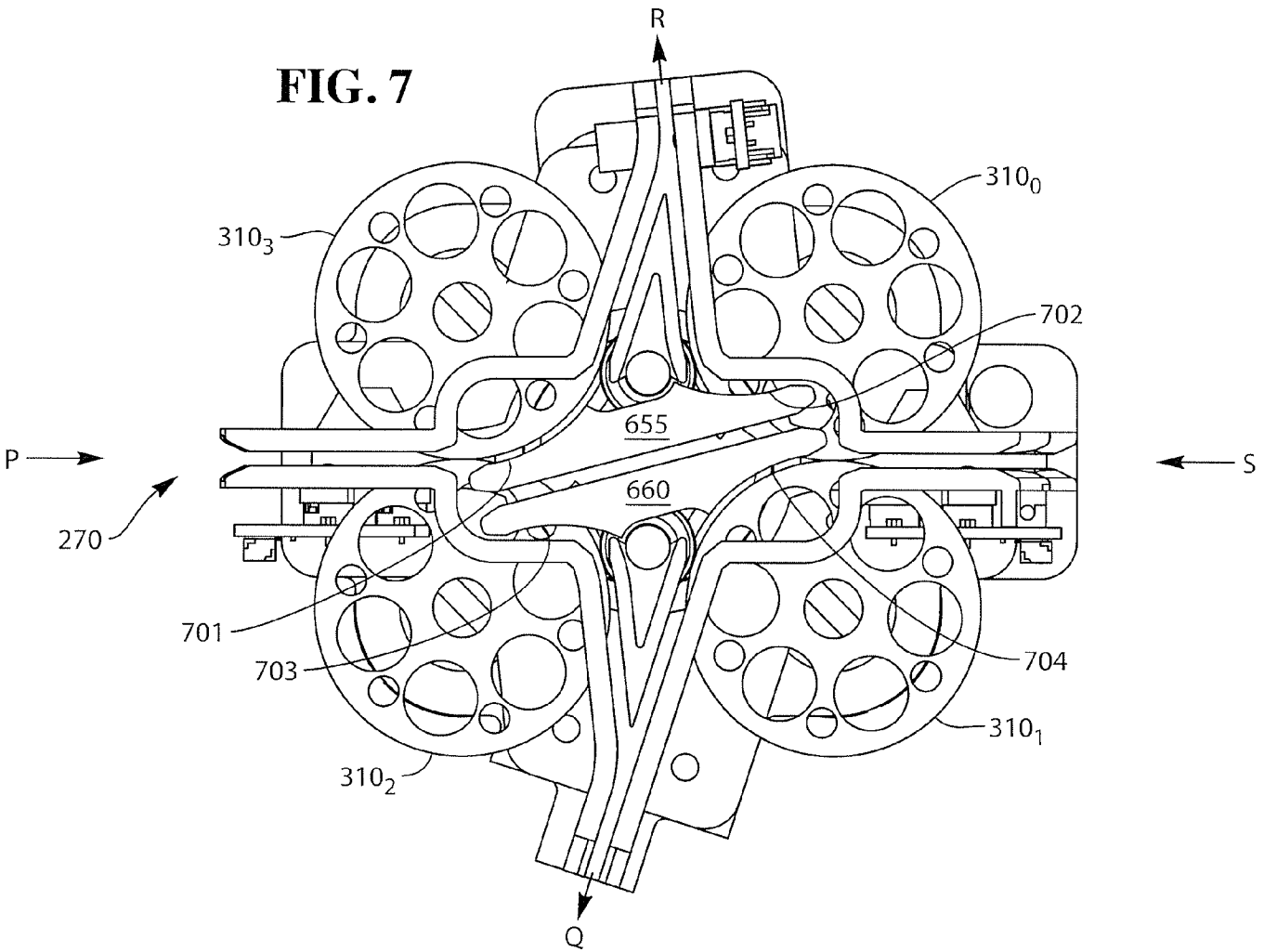
FIG. 7 illustrates a diverter mechanism in a second orientation.

FIG. 7 illustrates the pathway guide 650 in another one of the three possible orientations. In this position the sector gear has been driven and fixed at a further orientation which causes the shaft 337 connected to the sector gear to be rotated. This shaft is connected to an end of the pathway guide and causes the guide body to be pivoted within the chamber of the housing. This pivoting motion places respective guide surfaces on the outer side of the upper and lower parts 655, 660 of the pathway guide in the path of incoming items of media. In more detail, as shown in FIG. 7, the upper part 655 of the pathway guide has an arcuate guide surface 701 at a first upper end thereof and a further arcuate guide surface 702 at a further upper end thereof. Likewise, the lower body part of the pathway guide has an arcuate guide surface 703 at a first end thereof and a further arcuate guide surface 704 at a further end thereof. Each arcuate guide surface provides a substantially concave smooth running surface to guide items of media entering the diverter mechanism in one direction into in a further direction. As illustrated in FIG. 7, in this orientation the pathway guide can deflect an item of media substantially by about around ninety degrees. Aptly, the item of media is deflected by about around eighty degrees or more. By way of example shown in FIG. 7, an item of media entering the diverter mechanism in the direction shown by arrow P via the opening 270 on the left hand side will be deflected upwardly towards an upper opening 260 and out of the diverter mechanism following a pathway indicated by arrow R. Likewise, in the configuration shown in FIG. 7, an item of media entering the diverter mechanism along a pathway having a direction shown by arrow S will enter the diverter mechanism via an opening 280 shown on the right hand side of FIG. 7. The arcuate abutment surface 704 will cause the pathway to deviate and the item of media will be diverted substantially downwards (as shown in FIG. 7) and will exit the diverter mechanism in the direction of arrow Q shown in FIG. 7.

Figure 8:
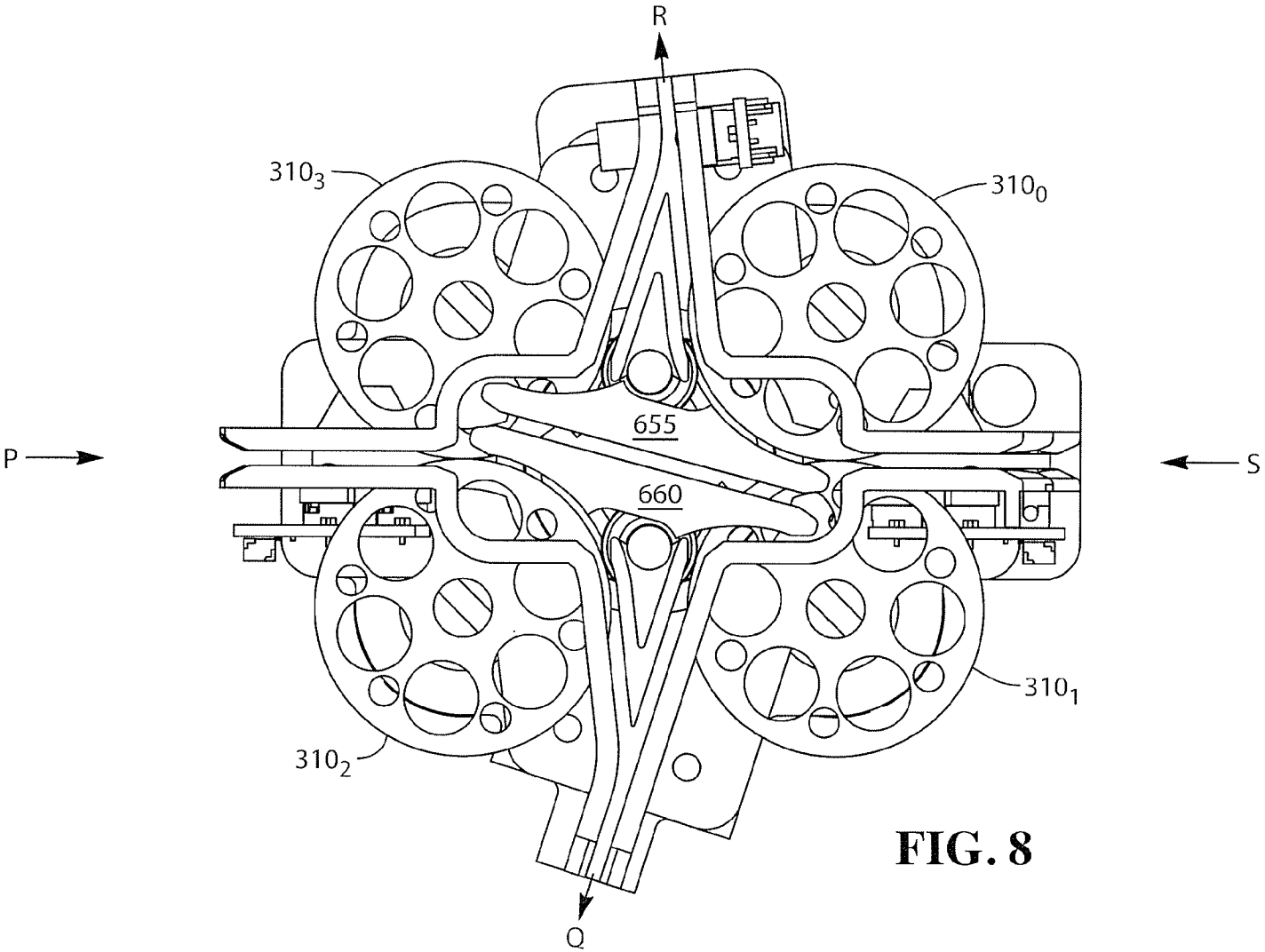
FIG. 8 illustrates a diverter mechanism in a third orientation.

FIG. 8 illustrates how with the pathway guide 650 in a third orientation, further transport pathway directions may be selected. That is to say, other options are provided for diverting a pathway of a transported item of media. As illustrated in FIG. 8, an item of media incoming via the direction shown by arrow P will be guided downwards and will exit the diverter mechanism following the pathway illustrated by arrow Q. Likewise, any item of media entering the diverter mechanism along the pathway indicated by arrow S will be directed substantially upwards and will exit the diverter mechanism along a pathway indicated by the arrow R.

By virtue of the diverter mechanism a bunch of up to one hundred items (which may be a mixture of checks and currency notes) can be inserted by a customer into an infeed at the ATM fascia. The items are separated at the feeder/separator and proceed onto the escrow after being de-skewed and read by imaging cameras and an MICR reader. Items that are determined to be neither checks nor cash are diverted by the four-way diverter mechanism directly to the re-buncher for return to a customer. Counterfeit items which are detected may be diverted by the diverter mechanism directly into a cash reject bin which forms part of the cash bin Once all of the legitimate items of media have been collected in the escrow, the details of the transaction may be displayed on the ATM screen. The screen displays the total amount of currency for deposit and images of the checks which have been deposited may also be displayed. An amount that has been recognized for each check may also be displayed. A customer can then OK the entire transaction for deposit or can then correct any amounts that have been recognized improperly. Optionally, a customer may also ask for certain items to be returned whilst other items are okayed to be deposited. Optionally, the customer may request all items in the escrow to be returned. Once a customer has made a decision, indicated by interaction with the user interface of the terminal, items are fed out of the escrow. Items that are to be returned to the customer are directed by the four-way diverter mechanism up to the re-buncher where they are reassembled into a single bunch before being returned. Items for deposit are directed by the four-way diverter mechanism to either the cash bin or check bin as appropriate.

Certain embodiments of the present invention thus provide a method of diverting items in four directions with a single compact diverter mechanism. The mechanism is capable of passing currency notes/checks along a bi-directional path whilst also being able to divert this flow either upward or downward from either of those bi-directional paths. A diverter centerpiece is stopped at one of three possible different positions and held in place to divert the item. A stepper motor engages a sector gear attached to the end of a diverter shaft which positions the shaft so that a desired path is open to receive media. A sensor may be used in conjunction with the stepper motor to aid in positional control. A bottom set of large drive wheels receive their drive from a different stepper motor within the module (optionally the same stepper motor may be utilized) to drive the media through the four-way diverter mechanism. The drive wheels are geared to another identical set located nearby. In between the upper and lower drive wheels are small bearings which help drive items of media around corners.

Certain embodiments of the present invention conserve module space within the chassis of an ATM which can thus be used for other functionality because of the compact nature of the diverter mechanism.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for determining a direction of transport of an item of media, comprising:

a diverter housing providing at least four openings through which an item of media is transportable;

a pathway guide member in a central chamber region of the housing selectively locatable in at least three orientations, said guide member comprising a plurality of guide surfaces that each guide an item of media travelling on a respective transport pathway; and at least one selection element that selects an orientation of the guide member as each item of media is transported to determine an opening through which an item of media exiting the housing is transported;

wherein the guide member can be (i) moved and releasably secured into a first guide member position when in a first mode of operation (ii) moved and releasably secured into a second guide member position when in a second mode of operation and (iii) moved and releasably secured into a third guide member position when in a third mode of operation; and each selection element can be (i) disposed in a first selection position to select the first mode of operation, (ii) disposed in a second selection position to select the second mode of operation and (iii) disposed in a third selection position to select the third mode of operation.

2. The apparatus as claimed in claim 1, further comprising:

the guide member comprises a first pair of opposed straight abutment surfaces that are spaced apart and substantially parallel and which extend centrally through a longitudinal length of the guide member, said straight abutment surfaces guiding an item from an input opening to an output opening substantially without deviation.

3. The apparatus as claimed in claim 1, further comprising:

the guide member comprises at least a first and second pair of outwardly facing arcuate abutment surfaces, each arcuate abutment surface guiding an item travelling on a respective transport pathway from an input opening to an output opening through which the item of media exits the housing with a deviation of substantially about around 90 degrees.

4. The apparatus as claimed in claim 1, further comprising:

the guide member comprises a split rocker body closed at a first and further end thereof, a driveshaft extending from at least a first end thereof with a lower surface of an upper portion of the split body providing a substantially straight abutment surface and an upper surface of a lower portion of the split body providing a further substantially straight abutment surface.

5. The apparatus as claimed in claim 1, further comprising:

the housing comprises four elongate body portions each having a substantially W-shaped cross-section secured together at first and second ends thereof via respective housing end walls;

wherein each W-shaped body portion is disposed around, and with a central concave region facing, a center of the housing, the combined space of the concave regions providing the chamber region.

6. The apparatus as claimed in claim 1, further comprising:

the at least one selection element comprises a sector gear connected to a driveshaft connected to the guide member, the apparatus further comprising a stepper motor that selectively engages the sector gear to locate the driveshaft in a respective first, second or third selection position.

7. The apparatus as claimed in claim 6, further comprising:

a sensor element that determines a position of the sector gear.

8. The apparatus as claimed in claim 1, further comprising:

at least two pairs of opposed nip rollers that drive items of media between openings in the housing; and a motor that drives the nip rollers.

9. A check or currency processing module for a Self-Service Terminal (SST), comprising the apparatus as claimed in claim 1, wherein each item of media is a check or currency note.

10. A method of determining a direction of transport for an item of media, comprising the steps of:

receiving an item of media at one of four openings in a diverter housing;

via at least one selection element, releasably securing a pathway guide member in a central chamber region of the housing in a selected one of three possible guide member positions;

via at least one abutment surface on the guide member, guiding the received item of media through a remaining opening in the diverter housing through which an item of media exiting the housing is transported; and locating the guide member in a selected guide member position by selectively energizing a stepper motor that engages with a sector gear connected to a driveshaft connected to the guide member.

11. The method as claimed in claim 10, further comprising the steps of:

driving the item of media through the remaining opening via one of at least two pairs of opposed nip rollers.

12. The method as claimed in claim 10, further comprising the steps of:

sensing a position of the sector gear via a sensor element.

13. A method of diverting an item of media, comprising the steps of:

transporting an item of media to one of two possible input openings in a diverter housing comprising four openings;

releasably securing a rotatable guide member in a central chamber region of the housing in one of three possible guide member positions, wherein each position corresponds to a different one of three remaining openings; and guiding the received item along a transport pathway in the housing to a corresponding opening in the diverter housing.

14. Apparatus for determining a direction of transport of an item of media, comprising:

a diverter housing providing at least four openings through which an item of media is transportable;

a pathway guide member in a central chamber region of the housing selectively locatable in at least three orientations, said guide member comprising a plurality of guide surfaces that each guide an item of media travelling on a respective transport pathway; and at least one selection element that selects an orientation of the guide member as each item of media is transported to determine an opening through which an item of media exiting the housing is transported;

wherein the guide member comprises a first pair of opposed straight abutment surfaces that are spaced apart and substantially parallel and which extend centrally through a longitudinal length of the guide member, said straight abutment surfaces guiding an item from an input opening to an output opening substantially without deviation.

15. Apparatus for determining a direction of transport of an item of media, comprising:

a diverter housing providing at least four openings through which an item of media is transportable;

a pathway guide member in a central chamber region of the housing selectively locatable in at least three orientations, said guide member comprising a plurality of guide surfaces that each guide an item of media travelling on a respective transport pathway; and at least one selection element that selects an orientation of the guide member as each item of media is transported to determine an opening through which an item of media exiting the housing is transported;

wherein the guide member comprises at least a first and second pair of outwardly facing arcuate abutment surfaces, each arcuate abutment surface guiding an item travelling on a respective transport pathway from an input opening to an output opening through which the item of media exits the housing with a deviation of substantially about around 90 degrees.

16. Apparatus for determining a direction of transport of an item of media, comprising:

a diverter housing providing at least four openings through which an item of media is transportable;

a pathway guide member in a central chamber region of the housing selectively locatable in at least three orientations, said guide member comprising a plurality of guide surfaces that each guide an item of media travelling on a respective transport pathway; and at least one selection element that selects an orientation of the guide member as each item of media is transported to determine an opening through which an item of media exiting the housing is transported;

wherein the guide member comprises a split rocker body closed at a first and further end thereof, a driveshaft extending from at least a first end thereof with a lower surface of an upper portion of the split body providing a substantially straight abutment surface and an upper surface of a lower portion of the split body providing a further substantially straight abutment surface.

17. Apparatus for determining a direction of transport of an item of media, comprising:

a diverter housing providing at least four openings through which an item of media is transportable;

a pathway guide member in a central chamber region of the housing selectively locatable in at least three orientations, said guide member comprising a plurality of guide surfaces that each guide an item of media travelling on a respective transport pathway; and at least one selection element that selects an orientation of the guide member as each item of media is transported to determine an opening through which an item of media exiting the housing is transported;

wherein the housing comprises four elongate body portions each having a substantially W-shaped cross-section secured together at first and second ends thereof via respective housing end walls; and wherein each W-shaped body portion is disposed around, and with a central concave region facing, a centre of the housing, the combined space of the concave regions providing the chamber region.

18. A method of diverting an item of media, comprising the steps of:

transporting an item of media to an opening in a diverter housing comprising a plurality of openings;

releasably securing a rotatable guide member in a central chamber region of the housing in one of a plurality of possible guide member positions, wherein each position corresponds to a different opening; and guiding the received item along a transport pathway in the housing to a corresponding opening in the diverter housing.

* * * * *